US005770437A

United States Patent [19]

Lantero, Jr. et al.

[11] Patent Number: 5,770,437

[45] Date of Patent: Jun. 23, 1998

[54] ENZYME COMPOSITION FOR THE TREATMENT OF STICKY COTTON FIBER AND METHOD FOR THE TREATMENT OF STICKY COTTON FIBER WITH SUCH ENZYME COMPOSITION

[75] Inventors: Oreste J. Lantero, Jr., Goshen; Jayarama K. Shetty, Elkhart, both of Ind.

[73] Assignee: Genencor International Indiana, Inc., Elkhart, Ind.

[21] Appl. No.: 487,391

[22] Filed: Jun. 7, 1995

Related U.S. Application Data

[62] Division of Ser. No. 54,226, Apr. 30, 1993, Pat. No. 5,516, 689.

[51] Int. Cl.[6] ..... D21C 1/00; D06M 16/00; C07G 17/00

[52] U.S. Cl. ..... 435/277; 435/200; 435/263; 435/264; 435/267; 424/94.61

[58] Field of Search ..... 435/263, 277, 435/200, 264, 267; 424/94.61

[56] References Cited

U.S. PATENT DOCUMENTS

| | | | |
|---|---|---|---|
| 4,343,070 | 8/1982 | Wade et al. | 19/40 |
| 4,481,355 | 11/1984 | Jaskowski | 536/2 |
| 4,575,487 | 3/1986 | Shetty et al. | 435/15 |

FOREIGN PATENT DOCUMENTS

| | | |
|---|---|---|
| 946 881 | 8/1956 | Germany . |
| 36 35 427 | 4/1987 | Germany . |
| 62-223309 | 10/1987 | Japan . |
| 750352 | 6/1956 | United Kingdom . |

OTHER PUBLICATIONS

Sigma Chemical Company Catalogue, 1990, p. 790.

Database WPI, Derwent Publications, AN 87–316551, JP–A–62 223 309, Oct. 1, 1987.

Proceedings Of The Beltwide Cotton Production Conference, vol. 2, pp. 671–673, 1992, D. Hendrix, et al., "Detection And Elimination Of Honeydew Excreted by the Sweetpotato Whitefly Feeding Upon Cotton".

Database WPI, Derwent Publications, AN 88–040101, JP–A–62 299 504, Dec. 26, 1987.

*Primary Examiner*—Leon B. Lankford, Jr.
*Assistant Examiner*—Francisco C. Prats
*Attorney, Agent, or Firm*—Cooley Godward LLP

[57] ABSTRACT

An enzyme composition and a means of reducing the stickiness of honeydew contaminated cotton is disclosed. The composition includes, and the method uses, enzymes such as transglucosidases and pectinases which are capable of hydrolyzing sugars that make-up honeydew.

12 Claims, 4 Drawing Sheets

0 HOURS

1 HOUR

4 HOURS

20 HOURS

0 HOURS

1 HOUR

4 HOURS

20 HOURS

0 TIME

4 HOURS

ENZYME COMPOSITION FOR THE TREATMENT OF STICKY COTTON FIBER AND METHOD FOR THE TREATMENT OF STICKY COTTON FIBER WITH SUCH ENZYME COMPOSITION

This is a Division, of application Ser. No. 08/054,226 filed on Apr.30, 1993 now U.S. Pat. No. 5,516,689.

BACKGROUND OF THE INVENTION

1. Field of the Invention

The present invention relates to the treatment of "Sticky Cotton" for the reduction of the stickiness on the cotton fibers and, in particular, to enzyme compositions and methods using such enzyme compositions for the treatment of "Sticky Cotton" fiber for achieving a reduction of the stickiness thereon.

2. Background of the Invention

"Sticky cotton" is a term used to refer to cotton fiber that has thereon sticky sugar deposits excreted by certain insects (mainly sweet potato whitefly) which feed on cotton leaves above open balls. Sticky cotton causes severe problems during the milling of cotton. Sticky cotton is a problem faced by cotton growers all over the world. The sticky substance is called "honeydew" and a number of publications have described methods of detecting honeydew in cotton. The composition of honeydew is a complex mixture of mono-, di, trisaccharides and small amounts of protein and organic acids (1,2). Hendrix et al. (3) developed High Pressure Liquid Chromatography (HPLC) techniques to separate oligosaccharides of honeydew up to pentasaccharides. A typical composition of the honeydew produced by white flies is 29.5% oligosaccharides, 10.1 % sucrose, 5.3 % glucose, 11.7 % fructose, and 43.1 % trehalulose (4).

Honeydew on cotton makes it difficult to process the cotton in gins and textile mills. Furthermore, the presence of such honeydew enhances the microbial fermentation for fiberstraining fungi which greatly deleteriously effects the fiber quality of the cotton. In gins, sticky cotton interferes with trash removal and requires gin blades to be cleaned more frequently, slowing ginning operation. This can significantly reduce the plant productivity. In textile mills, honeydew interferes with the major processing steps including carding, drawing, roving and spinning operations. Because of the adaptation of high speed technology, sticky cotton is a major threat in cotton production in many countries and plays an important quality consideration in the textile industry.

There seems to be limited work reported in reducing the stickiness of infected cotton. Beating the sticky cotton to 130°–140° C. for a short time was reported to caramelize the sugars in honeydew to avoid stickiness during spinning (5). The application of a hydrocarbon and surfactant additive to the cotton was reported to eliminate the sticking problem in yarn manufacturing (6). Another approach has been reported to spray contaminated cotton bales with dilute solutions of ammonium hydroxide or ammonium nitrate to enhance microbial breakdown of the sugars in honeydew (2). By this treatment, very sticky cotton lost all stickiness after 95 days. Others have indicated the use of insecticides to control cotton stickiness (7,8). The use of a material called Tempanil, reported to contain glucose oxidase, applied to contaminated cotton was found to significantly decrease soluble sugars (9). The change in stickiness of the treated cotton was not mentioned. Tempanil consists of two parts: a powdered preparation of glucose oxidase and catalase; and, a second part which is a liquid composed of a mixture of non-ionic and anionic wetting agents.

From the literature it can be seen very little has been done in the area of using enzyme to hydrolyze honeydew, except for the use of glucose oxidase. However, glucose oxidase only converts glucose to gluconic acid, and is not active on the sugars which are known to contribute to the stickiness of the cotton.

The complex low molecular weight di- and tri-saccharides i.e. trehalulose and maelezitose, contributing significantly to the stickiness of the contaminated cotton are resistant to the hydrolysis by the conventional carbohydrate hydrolysing enzymes These sugars contain simple sugars, glucose and fructose linked by alpha and beta glucosidic linkages. The structure of trehalulose and melezitose is given below.

(1) Trehalulose (O-α-D-glucopyranosyl-(1 ⟶ 1)-D-fructofuranoside)

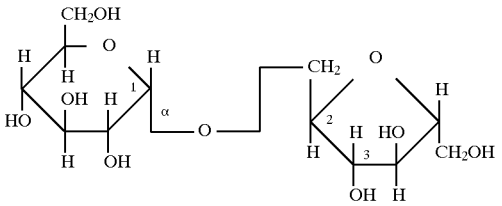

(2) Melezitose (O-α-D-glucopyranosyl-O-(1-2)-O-β-D-fructofuranosyl-(3-1)-α-D-glucopyranoside)

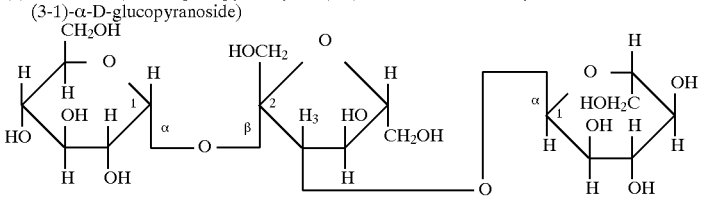

Accordingly, it can be seen that there remains a need to provide a composition, and in particular an enzyme composition, which is capable of hydrolyzing honeydew on cotton fiber. It can further be seen that there also remains a need for a method for the use of such an enzyme composition for the treatment of such sticky cotton fiber in order to effect a reduction in the stickiness thereon.

SUMMARY OF THE INVENTION

It is a primary object of the present invention to provide a composition, and in particular an enzyme composition, which is capable of hydrolyzing and/or otherwise reducing honeydew on cotton fiber for reducing the stickiness of such fiber.

It is a further primary object of the present invention to provide a method for the treatment of sticky cotton fiber in order to effect a reduction of the stickiness thereon. This method includes the use of transglucosidase, and/or pectinase for the preparation of an enzyme for at least partially hydrolyzing the honeydew on cotton fiber, whereby the stickiness of the cotton fiber is reduced.

In accordance with the teachings of the present invention, disclosed herein is an enzyme composition that is capable of hydrolyzing and/or otherwise reducing the presence of honeydew on cotton fiber, thereby reducing the stickiness thereon. This enzyme composition includes either transglucosidase and/or pectinase.

In further accordance with the teachings of the present invention, disclosed herein is a method for treating (enzymatically treating) sticky cotton fiber for effecting a reduction of the stickiness thereon. This method includes contacting said cotton fiber with an enzymatic composition including either a Transglucosidase or a pectinase.

These and further objects and advantages of the present invention will become readily apparent from a reading of the following description, taken in conduction with the enclosed drawings.

DETAILED DESCRIPTION OF THE INVENTION

Figure 1A:
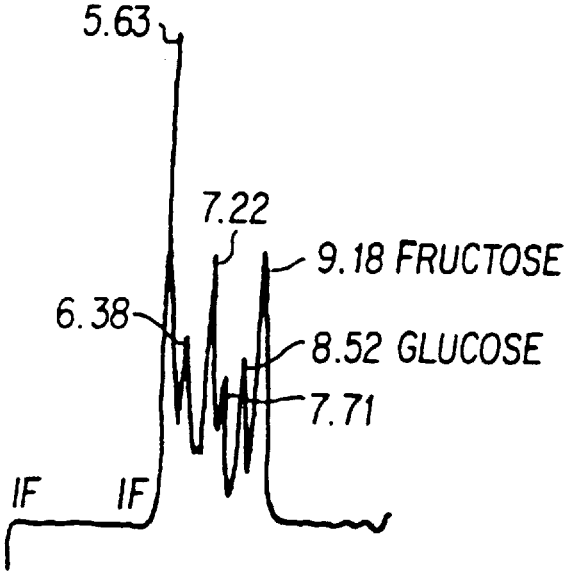
FIGS. 1A and 1B are HPLC chromatograms of the honeydew digest at, respectively, zero time and seventeen (17) hours, resulting from the enzyme (transglucosidase 1–6) hydrolysis test of honeydew extracted from sticky (contaminated) cotton fiber conducted, as described in Example 1.

The enzyme composition of the present invention includes enzyme(s) capable of hydrolyzing honeydew on cotton fiber. Such enzymes include transglucosidases and pectinases. The method of the present invention includes enzymatically treating the sticky cotton fibers with a composition that includes therein a hydrolyzing enzyme, such as transglucosidases and pectinases.

The novel enzyme preparations (compositions) disclosed herein are capable of reducing the stickiness on cotton fiber by hydrolyzing sugars in honeydew, preferably, melezitose and trehalulose. The enzymes of the present invention are preferably isolated from an Aspergillus species, particularly preferably from *Aspergillus niger*. The enzymes are suitably capable of hydrolyzing honeydew sugars of polymers containing glucose and fructose, preferably trehalulose and melezitose, a trisaccharide composed of fructose and glucose. Preferably, a transglucosidase or pectinase is used as the enzyme. Suitable enzyme preparations useful in accordance with the present invention are commercially available, for example TRANSGLUCOSIDASE L-1000 (a transglucosidase available from Solvay Enzymes, Indiana), CLAREX (a pectinase available from Solvay Enzymes, Indiana) PAREX 5X (a pectinase available from Solvay Enzymes, Indiana), and SUMIZYME AP-11 (available from Shin Nihon Chemicals Co. Ltd., Anjyo JAPAN). Further the method of enzymatic hydrolysis of these sugars as disclosed herein results in the reduction of the stickiness of the contaminated cotton, offering a simple, economical and safe solution to the major problem of the cotton growers all over the world.

Having generally described the composition and the method of the present invention, reference is now had to the following examples which are presented merely for illustration and should not be considered limiting.

EXAMPLE 1

Cotton contaminated with honeydew was obtained from Western Cotton Research Laboratory, USDA, ARS, Phoenix Arizona. A 15 gm sample of the contaminated cotton was extracted with 600 ml water at 50° C. The extraction was repeated for another three times. Each extraction involved wetting the cotton and mixing for 15 minutes and squeezing the water from the cotton by hand. The extracts were combined and concentrated in vacuum in a rotary film evaporator to about 10 ml. This extract was then used to screen for enzymes that would hydrolyze the honeydew.

To test for hydrolyzing enzyme activity, 0.5 ml extract at pH 4.5 was incubated at 50° C. with 0.02 ml of transglucosidase L-1000 preparation, produced by a selected strain of *Aspergillus niger* which has been deposited in the American Type Culture Collection, Rockville, Md., U.S.A., under accession number ATTC 14916, (this strain is sometimes classified as being a member of the species *Aspergillus foetidus*) and which has been cultured in an appropriate nutrient broth. The reaction was terminated by removing 0.2 ml sample of the reaction and placed in a boiling water bath for 10 minutes. After cooling, 0.3 ml of 0.01 N $H_2SO_4$ was added. This mixture was then centrifuged with an Eppendorf table top centrifuge, and the supernatant was clearified by filtration through a 0.45 micron filter. HPLC separation was then conducted on 0.02 ml sample run on BioRad HPX87H column (Bio-Rad USA) at 60° C., using a mobile phase (0.01 N $H_2SO_4$) flow rate of 0.7 ml/min. An Erma RI detector Model ER-7512 (Erma CA. Inc. Tokyo, Japan) was used for detection of sugars. The honeydew extract separated into peaks with glucose and fructose being the last two peaks. The conditions of separation in the column, low pH and high temperature cause sucrose to hydrolyze. The fate of sucrose in the presence of enzyme will not be fully understood under the conditions employed in HPLC. From the literature the composition of the oligosaccharides in honeydew is mainly polymers of glucose and fructose. Therefore any enzyme which hydrolyzes the oligosaccharides should result in an increase of glucose and/or fructose, with a corresponding decrease in oligosaccharide fractions.

Figure 1B:
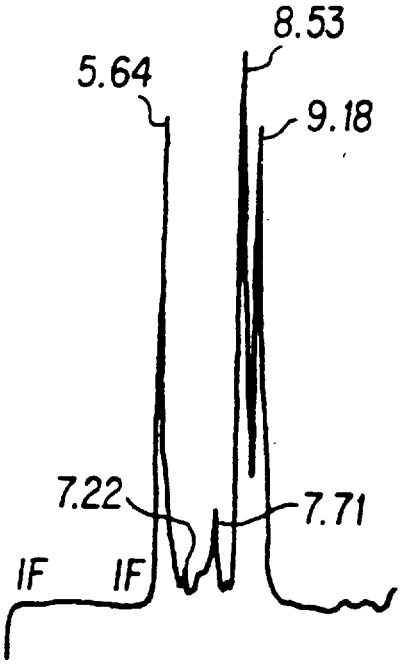
Figure 2A:
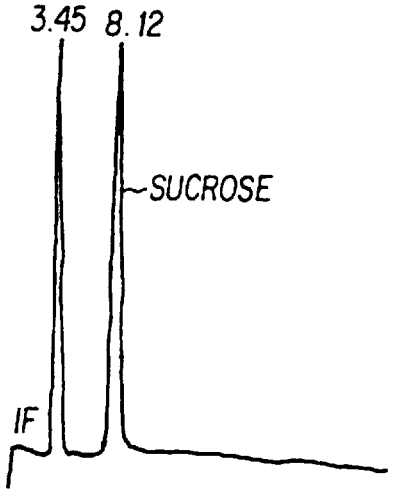
FIGS. 2A, 2B, 2C and 2D are HPLC (Biosil Amino 55) chromatograms of transglucosidase hydrolysis of sucrose at, respectively, zero time, one (1) hour, four (4) hours and twenty (20) hours, as described in Example 2.
Figure 2B:
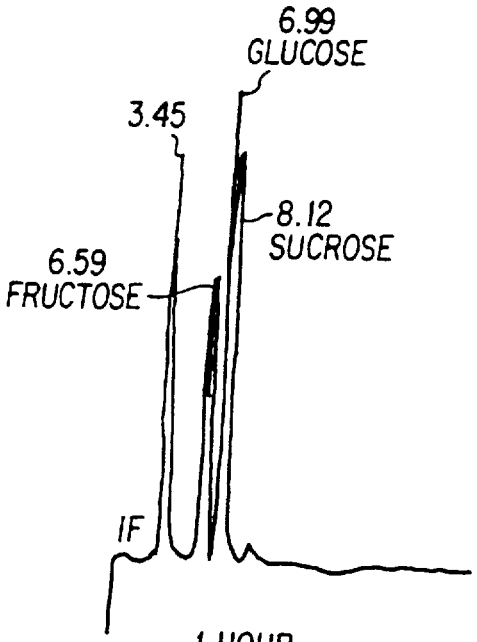
Figure 2C:
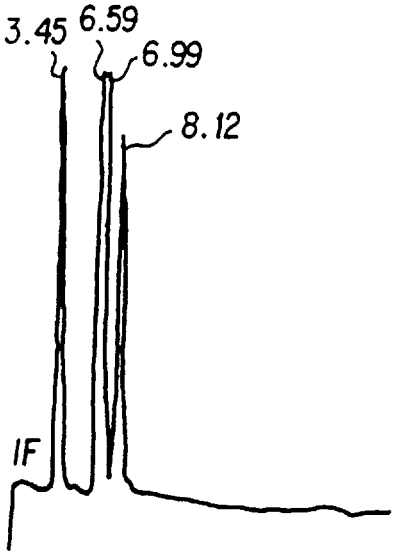
Figure 2D:
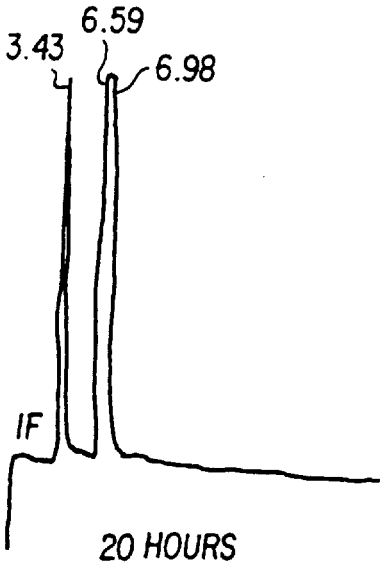
Figure 3A:
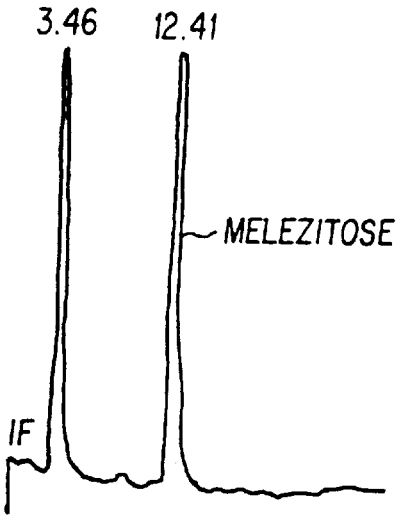
FIGS. 3A, 3B, 3C and 3D are HPLC (Biosil Amino 55) chromatograms of transglucosidase (1,6) hydrolysis of melezitose at, respectively, zero time, one (1) hour, four (4) hours and twenty (20) hours, as described in Example 2.
Figure 3B:
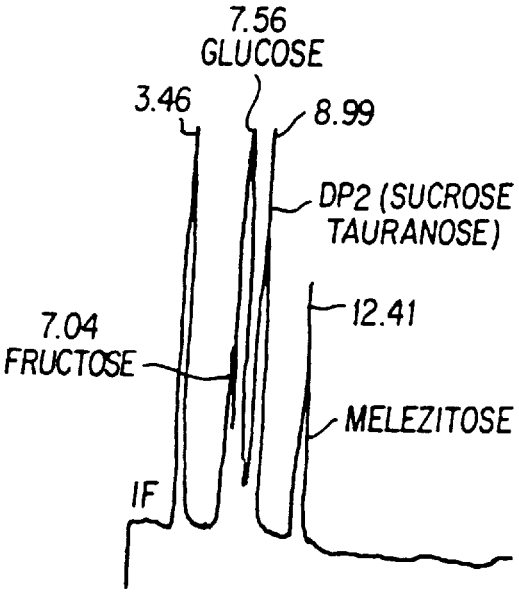
Figure 3C:
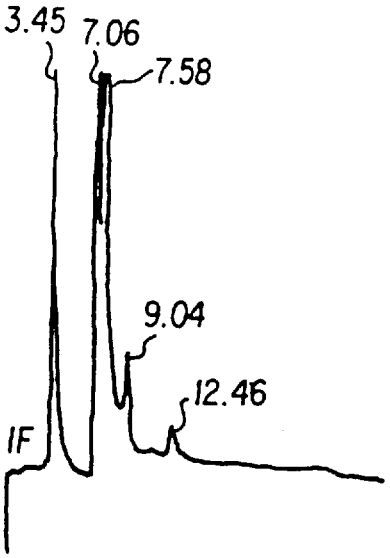
Figure 3D:
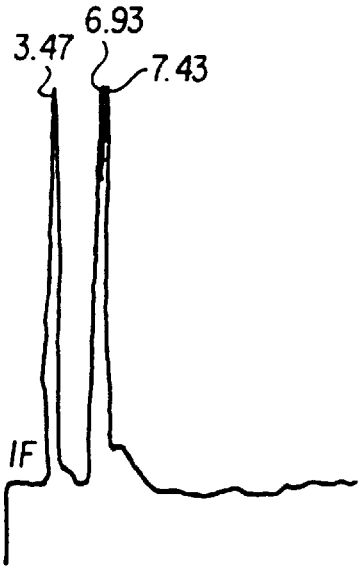

Transglucosidase isolated from the same selected strain of *Aspergillus niger* var. was tested as described above by adding 20 transglucosidase units to the honeydew extract (0.5 ml volume). A unit of transglucosidase is defined as the amount of enzyme required to produce one micromole of panose per minute under the conditions of the assay in which maltose is used as the substrate. A copy of the HPLC chromatograms from this assay is shown in FIG. 1 of the honeydew digest at zero time and after 17 hours. FIG. 1 clearly shows the increase of the monosaccharides (glucose and fructose) as the oligosaccharides of honeydew are hydrolyzed.

EXAMPLE 2

Transglucosidase hydrolysis of sucrose, trehalulose and melezitose

Honeydew is reported to contain sucrose, trehalulose, and melezitose (8). Since the HPLC conditions with the BioRad HPX-87H column hydrolyze sucrose, another HPLC column was found whose operating conditions did not cause hydrolysis of sucrose. BioRad Amino Bio Sil 5S column was found to give very good separation of the oligosaccharides and monosaccharides without hydrolyzing sucrose using mobile phase composed of 68 % acetonitrile and 32 % water. The column was operated at 25° C. with a mobile phase and a flow rate of 0.8 ml/min was used. A 20 $\mu$l sample of 4 % DS was found adequate for good separation.

Figure 4A:
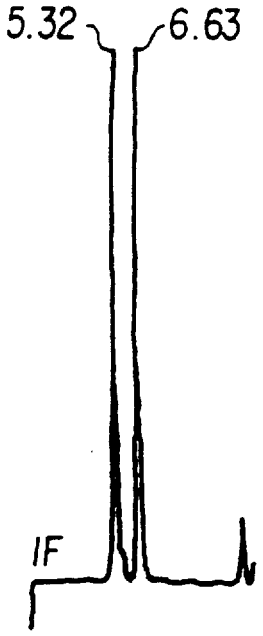
FIGS. 4A and 4B are HPLC (HPX-87H) chromatograns of transglucosidase hydolysis of trehalulose at, respectively, zero time and four (4) hours, as described in Example 2.
Figure 4B:
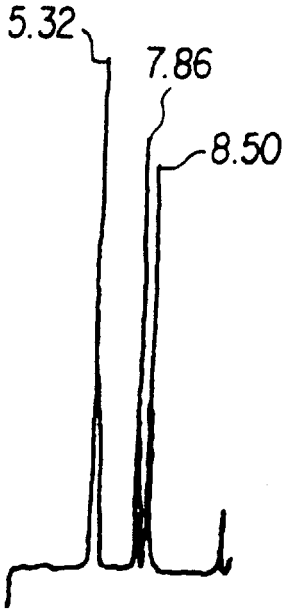

For enzyme digestion, 4 % solutions were made of each sugar (ACS grade or source indicated) in 0.02 M acetate buffer pH 5.0. The digestion was carried out at 50° C. using 10 ml of substrate and 50 units of transglucosidase. The reaction was terminated by incubating the digest in a boiling water bath for 10 minutes. Prior to injecting into the HPLC the digest was filtered through 0.45-micron filter. FIGS. 2–4 show the chromatograms of the hydrolysis of, respectively, sucrose, melezitose (Sigma Chemicals. St. Louis USA) and trehalulose (Gift from W. B. Miller, Clemson University) by transglucosidase. The results clearly demonstrated the hydrolysis of sucrose, trehalulose, and melezitose into glucose and fructose by the transglucosidase preparation.

These observations are unique, because normally transglucosidase hydrolyzes maltose and transfers one glycosyl residue to another maltose forming 1–6 linkage, producing panose. What makes the hydrolysis of the three sugars sucrose, melezitose and trehalulose so unusual is that all are made up of glucose and fructose i.e. sucrose [gluc-fruc, $\alpha\beta(1\rightarrow2)$], melezitose [agluc$(1\rightarrow2)$] $\beta$ fruc $(3\rightarrow1)$ $\alpha$gluc], and trehalulose [$\alpha$gluc $(1\rightarrow1)$ fruc].

EXAMPLE 3

Honeydew Hydrolysis by Commercial Pectinase Preparations

Honeydew extract as described in Example 1 was used to test various commercial enzyme preparations that contain pectinase activity. The procedure as described in Example 1 was used to test the enzymes for hydrolytic activity on honeydew. The following three pectinase containing enzyme preparations were found to hydrolyze honeydew: CLAREX TN(produced by SOLVAY ENZYMES, INC., Elkhart, Ind.)—a pectic hydrolytic enzyme system obtained from *Aspergillus niger* var.; PAREX 5X TN(produced by SOLVAY ENZYMES INC., Elkhart, Ind.)—a pectic hydrolytic enzyme system obtained from *Aspergillus niger* var. having significant arabinose activity; and Sumizyme AP-11—a pectinase obtained from Shin Nihon Chemicals Co. Ltd, Anjyo, Japan.

Obviously, many modifications may be made without departing from the basic spirit of the present invention. Accordingly, it will be appreciated by those skilled in the art that, within the scope of the appended claims, the invention may be practiced other than has been specifically described hereen.

References

1 Bates, R. B., D. N. Byrne, V. V. Kane, U. B. Miller and S. R. Taylor, *Carbohydrate Res.* (201), 342–345 (1990).

2 Heuer B., Z. Plant, A new approach to reduce sugar content of cotton fibers and its consequence for fiber stickiness. *Text. Res. J.* 55(5), 263–6 (1985).

3 Hendrix, D. L. and Y. A. Wei, *Bemisa Tabaci* honeydew.1: Carbohydrate composition and discovery of a novel trisaccharide, bemisiose. In Press.

4 Tarczynski, N. C., Dn. N. Byrne, and W. B. Miller. High performance liquid chromatography analysis of carbohydrates of cotton-phloem sap and of honeydev produced by *Bemisia tabaci* feeding on Cotton, Plant Physicol. 98 753–756 (1992).

5 Milnera, S. H., S. Sisman. Heat Treatment of raw cotton. *Melliancl Textilber*, 70(11) E348–E349 (1989).

6 Perkins, H. H., Jr. Identification and processing of honeydew-contaminated cottons. Text Res. J., 53(8) 508–12 (1983).

7 Gray, A., N. C. North, and A. N. Wright., The application of high performance liquid chromatography to the study of cotton stickiness. Cotton Fibers Trop. 40(2) 105–11 (1985).

8 Bruno, G. P., Decomposition of honeydew on cotton is the agricultural-industrial cycle of husking. Industrial Cotonier 35 227–230 (1982).

9 Hendrix, D. L., Y. Wis. Detection and elimination of honeydew excreted by the sweet potato white fly feeding upon cotton. Proceedings of the Beltwide Cotton Production Conference, 2 671–673 (1992).

What is claimed is:

1. A method for the treatment of cotton fiber having honeydew thereon, said method comprising contacting said cotton fiber with an enzymatic composition including a pectinase, whereby the honeydew is at least partially hydrolyzed.

2. The method of claim 1, wherein said pectinase is isolated from an Aspergillus species.

3. The method of claim 2, wherein said Aspergillus is an *Aspergillus niger.*

4. A method for the reduction of stickiness of cotton fiber, said method comprising contacting said cotton fiber with an enzymatic composition capable of hydrolyzing trehalulose.

5. The method of claim 4 wherein said enzymatic composition includes a pectinase.

6. The method of claim 4 wherein said trehalulose is at least partially hydrolyzed.

7. A method for the reduction of stickiness of cotton fiber, said method comprising contacting said cotton fiber with an enzymatic composition capable of hydrolyzing melezitose.

8. The method of claim 7 wherein said enzymatic composition includes a pectinase.

9. The method of claim 7 wherein said melezitose is at least partially hydrolyzed.

10. The method of claim 1, wherein said method further comprises a second step of processing said cotton fiber.

11. The method of claim 10, wherein said processing is ginning.

12. The method of claim 10, wherein said processing is selected from the group consisting of milling, carding, drawing, roving and spinning.

* * * * *